US009437934B2

(12) United States Patent
Pan et al.

(10) Patent No.: US 9,437,934 B2
(45) Date of Patent: Sep. 6, 2016

(54) DEVICE INCLUDING REFLECTIVE ELEMENT TO REFLECT DIRECTIONAL WIRELESS SIGNALS IMPINGING THEREON IN A DIRECTION AWAY FROM THE DEVICE

(71) Applicant: INTEL CORPORATION, Santa Clara, CA (US)

(72) Inventors: Helen K. Pan, Portland, OR (US); Raanan Sover, Haifa (IL)

(73) Assignee: Intel Corporation, Santa Clara, CA (US)

( * ) Notice: Subject to any disclaimer, the term of this patent is extended or adjusted under 35 U.S.C. 154(b) by 380 days.

(21) Appl. No.: 13/899,155

(22) Filed: May 21, 2013

(65) Prior Publication Data

US 2014/0347239 A1 Nov. 27, 2014

(51) Int. Cl.

| | |
|---|---|
| ***H01Q 15/14*** | (2006.01) |
| ***H01Q 1/24*** | (2006.01) |
| ***H01Q 3/16*** | (2006.01) |

(52) U.S. Cl.

CPC ..... *H01Q 15/14* (2013.01); *H01Q 1/243* (2013.01); *H01Q 3/16* (2013.01)

(58) Field of Classification Search

CPC ..... H01Q 15/14; H01Q 1/243; H01Q 1/245; H01Q 3/16; H01Q 3/18; H01Q 3/20

See application file for complete search history.

(56) References Cited

U.S. PATENT DOCUMENTS

2007/0188391 A1* 8/2007 Tu et al. ..... 343/702
2009/0121945 A1* 5/2009 Tani et al. ..... 343/702

FOREIGN PATENT DOCUMENTS

JP 2011244071 * 1/2011

* cited by examiner

*Primary Examiner* — Robert Karacsony
(74) *Attorney, Agent, or Firm* — SLGIP

(57) ABSTRACT

A computing device includes a body, the body having a first and second portion. The computing device further includes a directional antenna, the directional antenna transmitting a signal having a preferred direction, the directional antenna located in the first portion of the body. The computing device further includes a reflector for reflecting the signal, the reflector located in the second portion of the body, the body having a first configuration where the first portion is aligned with the second portion such that the preferred direction is not aligned to intersect the reflector, the body having a second configuration where the first portion is aligned with the second portion such that the preferred direction is aligned to intersect the reflector.

17 Claims, 4 Drawing Sheets

DEVICE INCLUDING REFLECTIVE ELEMENT TO REFLECT DIRECTIONAL WIRELESS SIGNALS IMPINGING THEREON IN A DIRECTION AWAY FROM THE DEVICE

TECHNICAL FIELD

Embodiments described herein generally relate to the use of directional antennas in mobile devices.

BACKGROUND

Mobile platforms, including laptops and convertible tablet type computers, include many types of wireless transmitters. Some transmitters radiate in a directions pattern, causing the antenna to have a preferred direction of transmission. These types of transmitters need not be pointed directly at the receiver to function; however, in some cases the transmission direction may be so far out of line that the receiver may experience significantly reduced reception.

DETAILED DESCRIPTION OF THE DRAWINGS

Described herein are embodiments of systems and methods for a Radiation Pattern Modifier in a Mobile device. A reflector is introduced into the mobile device configuration in order to prevent directional radiation sources (also known as directional antennas) from transmitting in a non-optimal direction. In this disclosure, the term reflector, reflective element, and reflective surface are used to describe 60 GHz solutions typically have a directional radiation pattern, that is a preferred direction of signal transmission. When referred to throughout this disclosure, 60 GHz does not only refer to the specific frequency of 60 GHz, but generally to the unlicensed 60 GHz Band, which will be apparent to those of ordinary skill in the art in light of this disclosure. Although the radiation modifier described herein may find frequent use in highly directional antennas in the range 30-300 GHz, it may be applied to any directional or omni-directional antenna, since even when used in conjunction with antennas without direction, reception and transmission may be improved. When an antenna is placed in a mobile platform, the radiation pattern direction from the antenna is a function of the physical location of the antenna in the platform. In general it is desirable for the radiation pattern and direction to be facing outward from the platform to establish a good link with a mating device (such as a docking station).

Figure 1:
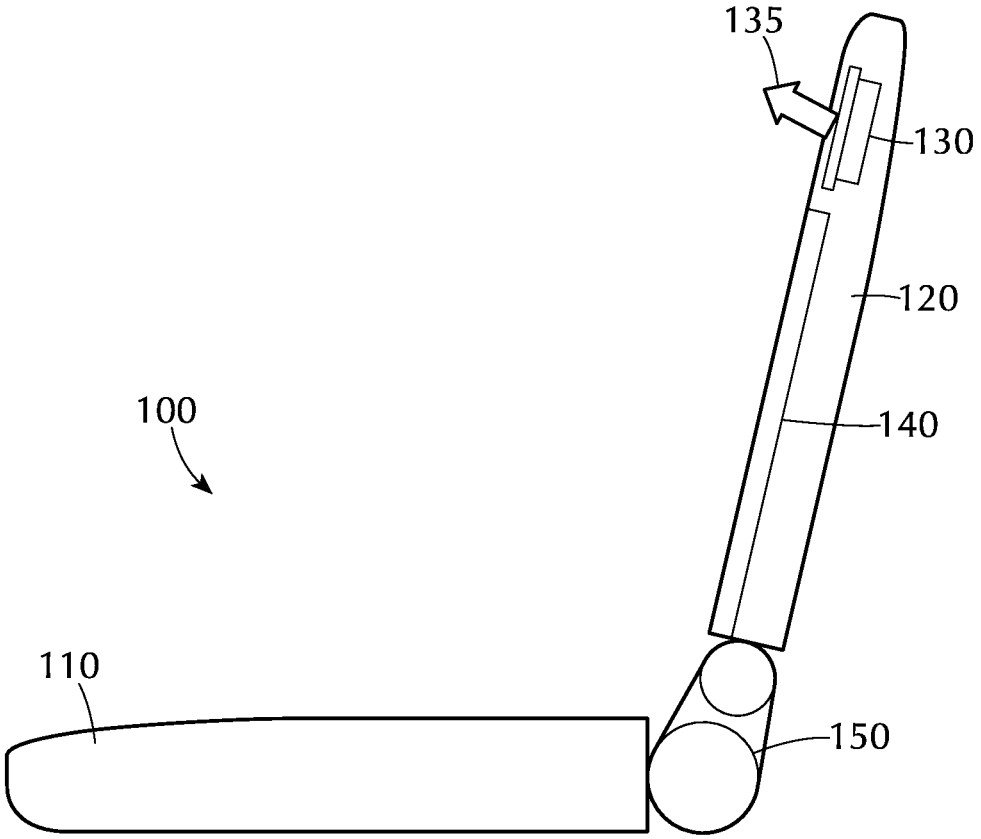
FIG. 1 shows one embodiment of a mobile device in an open position.
Figure 2:
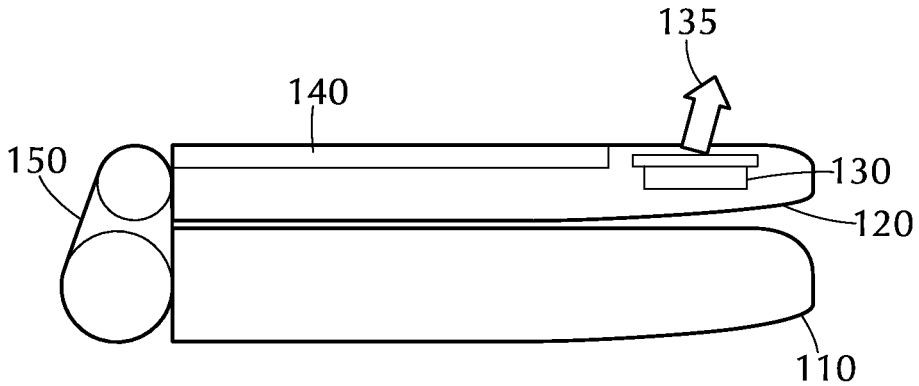
FIG. 2 shows the mobile device of FIG. 1 in a closed and outwardly facing position.

Examples of modes where the radiation pattern is facing outward from the platform are shown in FIG. 1 and FIG. 2.

In FIG. 1, device 100 includes a base 110 and a cover portion 120. In cover portion 120 a directional antenna or directional transmitter 130 and a screen 140 are located. Directional antenna 130 has a preferred transmission direction 135. Although certain transmission directions are shown throughout this disclosure, the transmission patterns possible are not limited to those shown. The transmission pattern shown is common, but transmission patterns are not limited to this example as other orientations may cause the transmission to be in other preferred directions. The cover portion 120 and the base 110 are joined via a double hinged connector 150. FIG. 1 shows device 100 in an open position. In FIG. 2, device 100 is shown in a closed and outwardly facing configuration.

Figure 3:
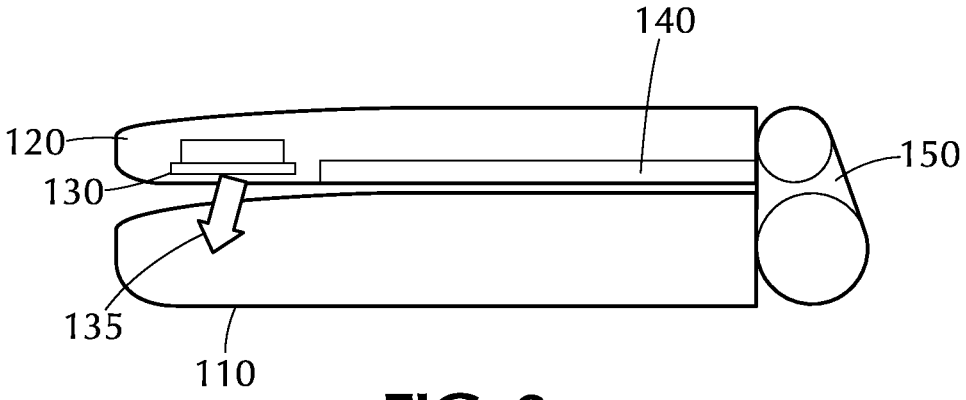
FIG. 3 shows the mobile device of FIG. 1 in a closed and inwardly facing position.

Some of the new Ultrabook™ and futuristic ULx configurations change the orientation and directions of the mobile platform surfaces so that if a directional antenna was located on such a surface, the transmission direction from that antenna could change as a function of the mode of operation of the platform. There are many additional convertible laptops and tablet computers that may also include a directional antenna, and the above are merely examples. This means that under certain conditions and modes of operation the radiation pattern direction could end up in an unwanted direction such as into the platform instead of outward. This inward radiation direction will degrade the wireless system performance significantly to the point that it may not work properly in this mode of operation and orientation. FIG. 3 shows an example of such a configuration. It would be desirable to have a convertible system that will provide improved transmission direction in a variety of positions.

In one embodiment, a reflective surface is disposed within a convertible mobile platform and located so as to reflect outward a wireless signal that would impinge on it, that is, a wireless signal that would have, but for the presence of the reflective surface, been facing inward to the platform.

60 GHz radiation patterns are typically directional. So wherever antennas are located, in or on a mobile platform surface, an antenna projecting a radiation pattern has an associated direction that should be pointed towards the receiver to have the best chance of establishing a connection. With the emergence of new convertible mobile platforms, the surfaces of the mobile platform can be in some configurations, facing outward and therefore enabling a wireless link and at other times be facing inward and inhibiting the formation a wireless link. This is because the radiation pattern would be facing into the platform itself and not outward toward the link mate.

This concept of introducing a reflective surface within the platform in a strategic location will provide for unwanted inward looking radiation pattern to be diverted outward where it can establish the desired wireless link. Many different configurations of a reflective surface will improve reception. In one configuration, any positioning of the reflective surface that results in a non-parallel arrangement of a directional antenna and the reflective surface will enhance the resulting transmission (this may be also described at the reflective surface being non-perpendicular to the transmission direction).

The reflective surface could be straight, bent or curved, although in the example diagrams a straight surface is shown. The angle of deflection of the radiation pattern may be limited by the dimensions available in the actual platform for this reflective surface. In all cases, the intent is to divert the direction of the radiation pattern outward even if it undergoes a shape change from that of the original radiation pattern.

Figure 4:
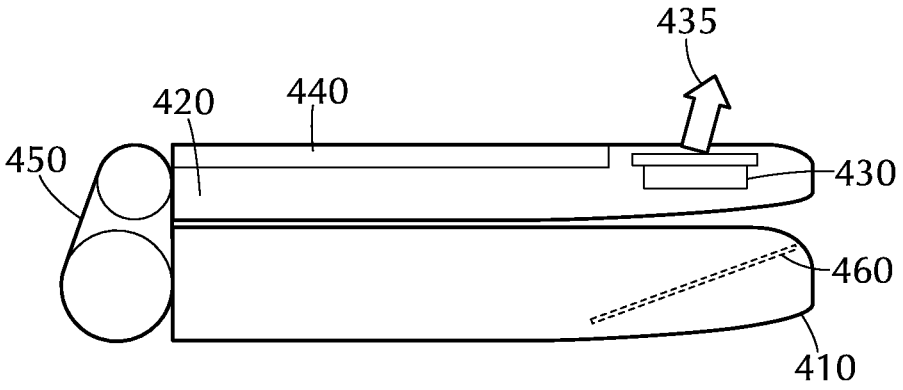
FIG. 4 shows one embodiment of a mobile device, including a reflector, in a closed and outwardly facing position.

In the convertible example shown in FIG. 4, during a tablet mode, where the display 440 is folded outward over the base section 410, the radiating element 430 is located on the same side as the Display 440 (labeled LCD) facing upward. It will be radiating in the outward direction 435 toward the viewer looking at the display 440. The Base 410 of the platform would be folded behind the Display section 420 about double hinge 450. In this case, the radiation pattern direction outward enables the establishment of a wireless link with a mating device.

Figure 5:
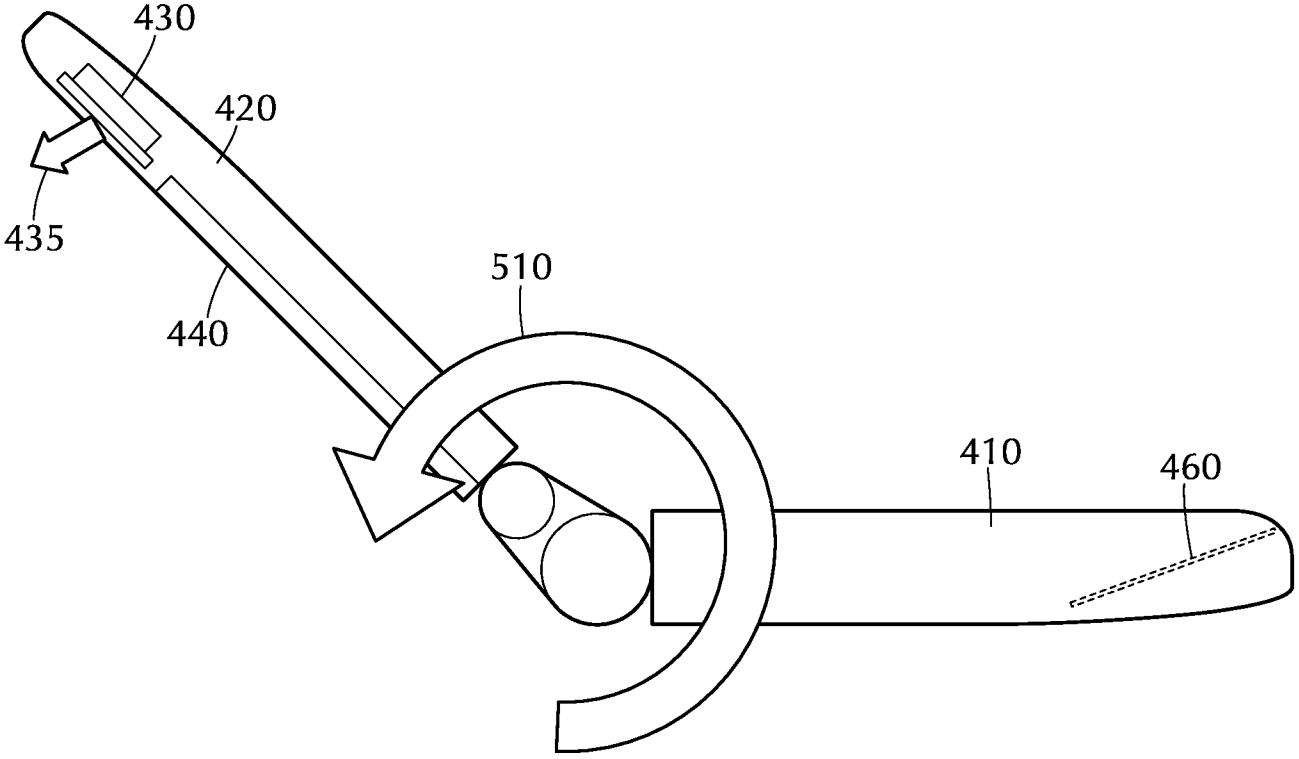
FIG. 5 shows the mobile device of FIG. 4 in an open position.
Figure 6:
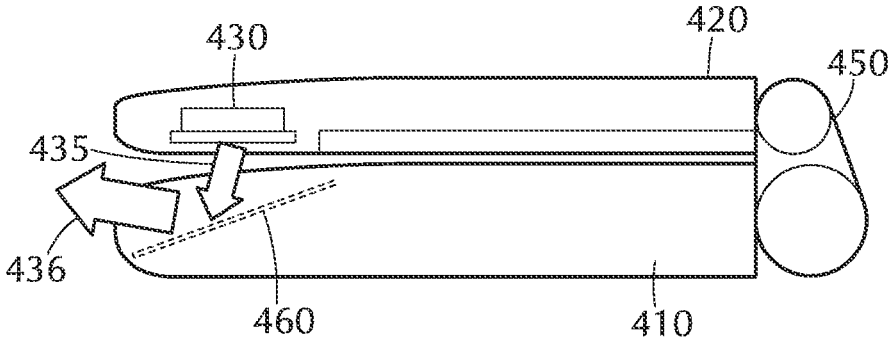
FIG. 6 shows the mobile device of FIG. 4 in a closed and inwardly facing position.

When taking this convertible device and folding it so that the display is closed on the base in direction 510 as shown in FIG. 5, the directional antenna (or radiating element) would be facing inward towards the base 410 and any radiation coming out of radiating element 430 would radiate directly into the base 410 and not necessarily radiate out of the platform (other than leakages). Therefore a wireless link will be difficult or impossible to establish. As shown the lid 420 can fold onto the base 410.

By introduction of a reflective element 460, strategically located in the base 410, so that when the lid display 420 is closed and radiating element 430 is radiating inward, the reflective element 460 will deflect the radiation outward 436 towards the side of the platform and enable the wireless link to be established.

In essence, by the inclusion of the reflective element, the radiation pattern 435 is always directed outward of the platform to enable the establishment of the wireless link with the mating device such as a docking station.

Although the example shown is for a double hinged type of convertible, the concept is true for other types of convertibles that also have cases where the directional antenna is radiating in the direction inward into the platform instead of outward toward an external mating device. These types of devices, may include those with a single hinge and a swivel piece allowing the display section to rotate and devices with a hinge, a slide mechanism that allows the display section to slide over the base section, and a device with a base hinge for the display section and a center hinge for the display section, allowing the display section to flip. The reflector is not limited to usage in these types of devices, and can be implemented in any device where through different configurations, a first portion of the device having a directional antenna may end up oriented in a non-optimal position considering the transmission direction. The reflector may also be deployed in a docking station or a case, when it is know that the directional antenna may end up transmitting in a non-optimal (typically a downward) direction when in use. Although the directional antenna is typically shown as being deployed in the display portion of the laptop or device, the directional antenna and corresponding reflector may be deployed in the base and the display portion, respectively.

In another configuration, a ground/power plane of an electrical board contained in the electronic device may be positioned and configured to acts as a reflective element 460. Power planes are special solid copper internal layers, typically used to provide an electrically stable ground or power reference throughout the printed circuit board. Internal layer electrical routing can also provide a metal surface as reflector. In this way, the existing internal structure of the electronic device may merely be repositioned to optimize transmission. In many configurations, the directional antenna will be at a non-parallel angle to the frame of that it is positioned in. This will allow the power plane of the electronic device to be parallel to the frame of the electronic device, ultimately resulting in the power plane and the directional antenna being non-parallel.

In some configurations, the reflector may be a thin piece of metal, such as copper foil or other metallic material. In forming the reflector, a foil like material may simply be pressed into receiving area, molded and angled to provide the proper angle and shape for the reflector. Although, in many implementations the 60 GHz transmission range may be targeted, the reflector may be used in concert with transmitters of other ranges. The 60 GHz transmission range is typically an unregulated range (by compliance entities, such as the FCC, Federal Communications Commission), so it is at times utilized for transmissions. The reflector may be used with any directional transmitter, but finds use at least in the range of frequency between 30-300 GHz. The material of the case for the mobile devices discussed herein, typically are not made of highly reflective material for the signals transmitted, since they are typically made of ABS, poly carbonate, glass fiber reinforced plastic, etc. In some configurations however, the mobile device may be made of aluminum or some other metal. In this case, the reflector may be incorporated into the exterior design of the case or the case may have a cutout where non-reflective material is used (having the reflective material beneath this section).

Figure 7:
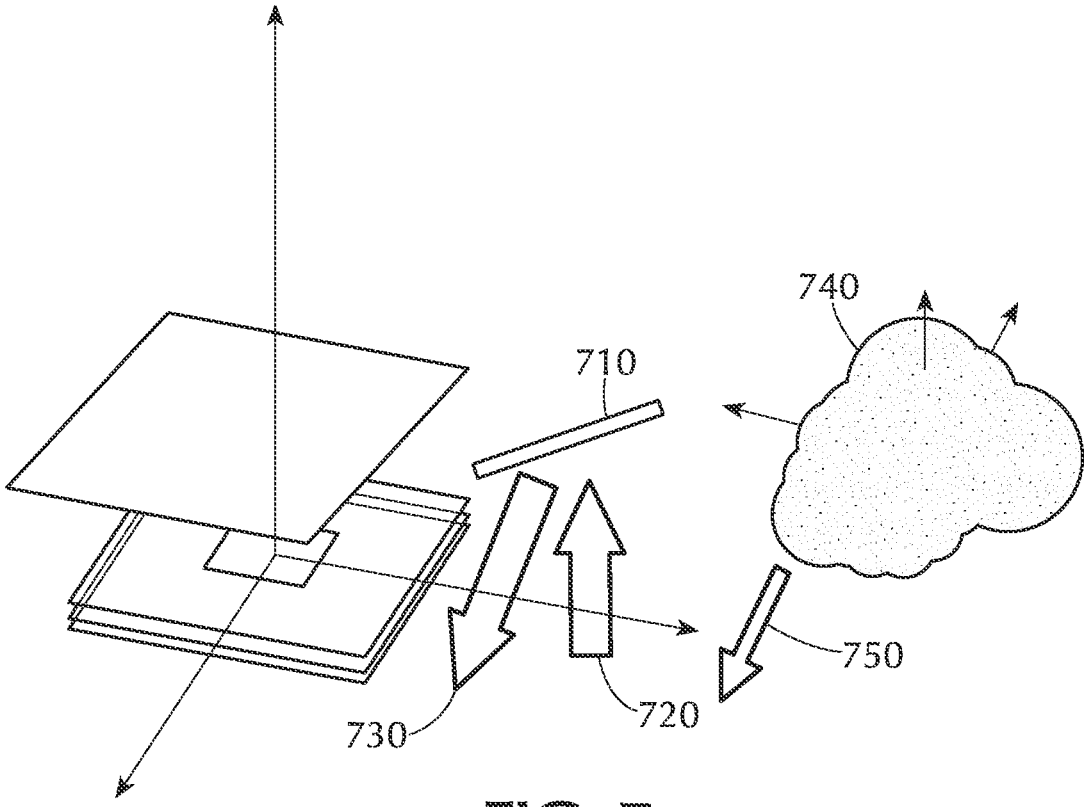
FIG. 7 shows a simulation analysis of a mobile device having a reflector.

FIG. 7 shows the results of a simulation using reflector 710. Incident signal 720 is reflected off of reflector 710 to create reflected signal 730. Radiation pattern 740 shows that in direction 750, the radiation pattern is strong. Simulation of a Single Element with reflective surface shown but concept is also applicable to an antenna array.

Much of the previous description is described in relation to a directional antenna transmitting signals. Equal problems may apply to the directional antenna receiving transmissions. Therefore, a substantially similar solution may be deployed to provide more optimized reception for a directional antenna. Instead an incoming signal will first strike the reflector described herein and then be transferred to the antenna. In many embodiments, a single directional antenna may be a directional transmitter and receiver. This concept applies to many of the examples herein even though the most examples describe the transmission of signals from a directional antenna.

In one embodiment, a computing device includes a body, the body having a first and second portion. The computing device further includes a directional antenna, the wireless directional antenna transmitting a signal having a preferred direction, the directional antenna located in the first portion of the body. The computing device further includes a reflector for reflecting the signal, the reflector located in the second portion of the body, the body having a first configuration where the first portion is aligned with the second portion such that the preferred direction is not aligned to intersect the reflector, the body having a second configuration where the first portion is aligned with the second portion such that the preferred direction is aligned to intersect the reflector. Optionally, the first and second portion of the body are connected via a double hinge. In one alternative, the first and second portion of the body are connected via a tilt and slide mechanism. In another alternative, the first and second portion of the body are connected via a hinge and rotation mechanism. Optionally, in the first configuration is an open configuration where the first portion is approximately perpendicular to the second portion. Alternatively, the second configuration is a closed configuration, where the first portion is approximately paralleled to the second portion. In one configuration, the reflector is straight and is angle to reflect the signal at an angle to the preferred direction. Optionally, the reflector is curved and is angle to reflect the signal at an angle to the preferred direction. In another configuration, the directional antenna transmits at a frequency, and the frequency is between 30-300 GHz. Optionally, the frequency is the 60 GHz band/range. In one configuration, the reflector is oriented such that in the second position the reflector causes the signal is projected outward away from the computing device and a surface upon which the computing device rests. In another configuration, the second portion of the body is the base of the computing device. Optionally, the reflector is a power plane.

In one embodiment, a method of providing a signal to a receiver from a computing device includes configuring the computing device in a first position, the computing device having a first and second body portion and a directional antenna, the directional antenna located in the first portion of the body, the first and second body portion positioned approximately perpendicular to each other in the first position. The method further includes transmitting a signal having a preferred direction in relation to the first portion of the body using the directional antenna, the preferred direction being away from the second portion of the body when the body is in the first position. The method further includes configuring the computing device is a second position, the first and second body portion positioned approximately parallel to each other in the second position. The method further includes transmitting the signal in the preferred direction, the preferred direction being towards the second portion of the body when the body is in the second position. The method further includes reflecting the signal with a reflector located in the second portion of the body. Optionally, the first and second portion of the body are connected via a double hinge. Alternatively, the first and second portion of the body are connected via a tilt and slide mechanism. In one alternative, the first and second portion of the body are connected via a hinge and rotation mechanism. Optionally, the first and second portion of the body are connected via a tilt and swivel mechanism. Optionally, the reflector is straight and is angled to reflect the signal at an angle to the preferred direction. In another alternative, the reflector is curved and is angle to reflect the signal at an angle to the preferred direction. Optionally, the directional antenna transmits at a frequency, and the frequency is between 30-300 GHz. In another alternative, the frequency is the 60 GHz band/range. Optionally, the reflector is oriented such that in the second position the reflector causes the signal is projected outward away from the computing device and a surface upon which the computing device rests. In one configuration the second portion of the body is the base of the computing device. Optionally, the reflector is a power plane.

In another embodiment, a computing device includes a body, the body having a first and second portion. The computing device includes a directional antenna to transmit signals in a preferred direction, the antenna located in the first portion of the body. The computing device includes a reflector located in the second portion of the body, the body having a first configuration where the signals do not impinge upon the reflector, and a second configuration where do impinge upon the reflector such that the reflector reflects the signals in a direction outward from the body.

In another embodiment a computing device includes a body of the computing device, the body having a first and second portion. The computing device further includes a directional antenna, the directional antenna transmitting a signal having a preferred direction, the directional antenna located in the first portion of the body. The computing device further includes a reflector for reflecting the signal, the reflector located in the second portion of the body, the body having a first configuration where the first portion is aligned with the second portion such that the preferred direction is away from the second portion and a second configuration where the first portion is aligned with the second portion such that the preferred direction is towards from the second portion and the reflector redirects the signal away from the second portion.

The previous detailed description is of a small number of embodiments for implementing the systems and methods for a Radiation Pattern Modifier in a Mobile Device and is not intended to be limiting in scope. The following claims set forth a number of the embodiments of the systems and methods for a Radiation Pattern Modifier in a Mobile Device disclosed with greater particularity.

What is claimed:

1. A computing device, the device comprising:

a body, the body having a first and second portion;

a directional antenna to transmit signals in a preferred direction, the antenna located in the first portion of the body; and a reflector located in the second portion of the body, the body having a first configuration where the signals do not impinge upon the reflector, and a second configuration where the signals impinge upon the reflector such that the reflector reflects the signals in a direction outward from the body;

wherein the reflector is curved and is angled to reflect the signal at an angle to the preferred direction.

2. The computing device of claim 1, wherein the first and second portion of the body are connected via a connector selected from the group consisting of a double hinge, a tilt and slide mechanism, a hinge and rotation mechanism, and a tilt and swivel mechanism.

3. The computing device of claim 2, wherein in the first configuration is an open configuration were the first portion is approximately perpendicular to the second portion.

4. The computing device of claim 3, wherein the second configuration is a closed configuration, where the first portion is approximately parallel to the second portion.

5. The computing device of claim 1, wherein the reflector is straight and is angled to reflect the signal at an angle to the preferred direction.

6. The computing device of claim 1, wherein the directional antenna is configured to transmit at a frequency between 30-300 GHz.

7. The computing device of claim 1, wherein a frequency of the directional antenna is in a 60 GHz band.

8. The computing device of claim 1, wherein the reflector is oriented such that in the second position, and if the computing device were to rest on a surface, the reflector would reflect the signals away from the surface.

9. The computing device of claim 8, wherein the second portion of the body is a base of the computing device.

10. The computing device of claim 1, wherein the reflector is a power plane.

11. A method of providing a signal to a receiver from a computing device, the method comprising:

configuring the computing device in a first position, the computing device having a first and second portion of a body and a directional antenna, the directional antenna located in the first portion of the body, the first and second portion positioned approximately perpendicular to each other in the first position;

transmitting a signal having a preferred direction in relation to the first portion of the body using the directional antenna, the preferred direction being away from the second portion of the body when the body is in the first position; configuring the computing device in a second position, the first and second portion positioned approximately parallel to each other in the second position; transmitting the signal in the preferred direction, the preferred direction being towards the second portion of the body when the body is in the second position; reflecting the signal with a reflector located in the second portion of the body;

wherein the reflector is a power plane.

12. The method of claim 11, wherein the first and the second portions of the body are connected via a connector selected from the group consisting of a double hinge, a tilt and slide mechanism, a hinge and rotation mechanism, and a tilt and swivel mechanism.

13. The method of claim 11, wherein the reflector is straight and is angled to reflect the signal at an angle to the preferred direction.

14. The method of claim 11, wherein the directional antenna transmits at a frequency and the frequency is between 30-300 GHz.

15. The method of claim 14, wherein the frequency is in a 60 GHz band.

16. The method of claim 11, wherein the reflector is oriented such that in the second position the reflector causes the signal to be directed outward away from the computing device and a surface upon which the computing device rests.

17. A computing device, the device comprising:

a body of the computing device, the body having a first and second portion;

a directional antenna, the directional antenna transmitting a signal having a preferred direction, the directional antenna located in the first portion of the body; a reflector for reflecting the signal, the reflector located in the second portion of the body, the body having a first configuration where the first portion is aligned with the second portion such that the preferred direction is away from the second portion and a second configuration where the first portion is aligned with the second portion such that the preferred direction is towards the second portion and the reflector redirects the signal away from the second portion;

wherein the reflector is a power plane.

* * * * *